US005466122A

United States Patent [19]

Charbonnel et al.

[11] Patent Number: 5,466,122

[45] Date of Patent: Nov. 14, 1995

[54] TURBINE ENGINE STATOR WITH PIVOTING BLADES AND CONTROL RING

[75] Inventors: Jean-Louis Charbonnel, Boissise Le Rot; Philippe Guerout, Chartrettes; Jacques L. Happey, Voisenon; Frédéric G. J. Mainfroy, Corbeil Essonnes; Jacky Naudet, Bondoufle; Jean-Claude Porcher, Gretz-Armainvilliers, all of France

[73] Assignee: Societe Nationale d'Etude et de Construction de Moteurs d'Aviation "SNECMA", Paris, France

[21] Appl. No.: 281,036

[22] Filed: Jul. 27, 1994

[30] Foreign Application Priority Data

Jul. 28, 1993 [FR] France ..... 93 09266

[51] Int. Cl.[6] ..... F01D 17/16

[52] U.S. Cl. ..... 415/160; 415/139; 415/200; 415/149.4

[58] Field of Search ..... 415/149.2, 149.4, 415/159, 160, 162, 200

[56] References Cited

U.S. PATENT DOCUMENTS

| | | | |
|---|---|---|---|
| 2,862,687 | 12/1958 | Aguet et al. . | |
| 2,999,630 | 9/1961 | Warren et al. | 415/149.4 |
| 3,632,224 | 1/1972 | Wright | 415/149.4 |
| 4,214,852 | 7/1980 | Tuley et al. | 415/159 |
| 4,615,658 | 10/1986 | Kagohara et al. | 415/200 |
| 4,618,311 | 10/1986 | Miura et al. | 415/149.4 |
| 4,659,282 | 4/1987 | Popp | 415/200 |
| 4,755,104 | 7/1988 | Castro et al. . | |
| 5,224,820 | 7/1993 | Brichet et al. | 415/159 |
| 5,318,402 | 6/1994 | Baily et al. | 415/139 |
| 5,328,328 | 7/1994 | Charbonnel et al. | 415/160 |

FOREIGN PATENT DOCUMENTS

| | | |
|---|---|---|
| 623280 | 2/1963 | Belgium . |
| 2583820 | 12/1986 | France . |
| 1136350 | 9/1962 | Germany . |
| 1466613 | 3/1977 | United Kingdom . |
| 1505858 | 3/1990 | United Kingdom . |
| 2254381 | 7/1992 | United Kingdom . |

*Primary Examiner*—Edward K. Look
*Assistant Examiner*—Mark Sgantzos
*Attorney, Agent, or Firm*—Oblon, Spivak, McClelland, Maier, & Neustadt

[57] ABSTRACT

A turbine engine stator has a metal casing surrounding an envelope carrying bearings for the pivots of pivoting blades. A control mechanism for setting the position of the blades includes a radial spindle to which are transmitted the thrust forces of the gases, the envelope being advantageously formed from angular sectors of axially juxtaposed flanges or rings and which are not loaded. Therefore, the bearings are not subject to wear giving rise to gas leaks and efficiency losses. Advantageously, the envelope is made from a composite material.

6 Claims, 5 Drawing Sheets

19
16
21
15
20
17
9
9
2
8
14
8
10
13
8
3
9
10
14
12
42
12
4
1
6
5
6
5
6
5
7
5
7
42
27
43
44
29
43
19
28
15

TURBINE ENGINE STATOR WITH PIVOTING BLADES AND CONTROL RING

BACKGROUND OF THE INVENTION

1. Field of the Invention

The invention relates to a turbine engine stator having pivoting blades and a control ring.

2. Discussion of the Background

Particularly for the high pressure stages of compressors, numerous turbine engines have stator blades, which are pivotable and not fixed in order to modify the characteristics of the straightening of the gases passing through the passage in which said blades extend. Such variable setting blades therefore incorporate pivots extending through an envelope, which defines the stream or passage and said pivots are connected to links, which are normally joined together by a control ring placed around the passage and a control mechanism displaces the same in translation along the axis of the turbine engine or in rotation about said axis. In both cases, the links rotate and drive the pivots of the blades.

A disadvantage of this system is that to the thrust of the gases producing significant forces and stresses on the blades. These stresses are transmitted to the pivots and to the bearings of the envelope supporting the same and have a preferred direction. The friction exerted by the pivots when they rotate is responsible for a concentrated wearing of the bearings, so that the shape thereof undergoes ovalization. The stream then leaks into other volumes of the turbine engine, whose output decreases due to the gas leaks which occur. These disadvantages are even more marked if the sought compression ratio for the gases is high, because the thrust is greater and the faster wear results. Thus, in the presently known constructions, the envelope carrying the bearings of the pivots and which defines the stream or passage has a considerable rigidity and is made from steel, so that it is very heavy. The conventionally sought substitution of steel with titanium in order to lighten the structure is not possible here due to the temperature of the gases of the stream and the risks resulting therefrom of the titanium burning.

SUMMARY OF THE INVENTION

The essential object of the invention is to separate the envelope carrying the bearings of pivots of pivoting blades and undergoing stresses due to the pressure of the gases, from the casing, which is subject to structural forces, without compromising the seal between the pivots and the bearings. The fundamental advantage obtained is that the envelope could henceforth be made from a composite material which has a significantly reduced weight. In brief, the solution retained for this purpose consists of the forces of the gases being withstood by a bearing constructed on a separate casing of the envelope and which is occupied by a rotary spindle belonging to the control mechanism. The forces suffered by the blades are therefore transmitted by the pivots, the links, the control ring and part of the control mechanism up to the spindle in question and are then spread within the casing of the engine which is perfectly able to withstand them.

It is pointed out that there are already arrangements where the control mechanism is partly supported by a casing surrounding the envelope defining the stream, such as is illustrated by British Patent 2,254,381. However, the forces of the thrust of the gases are taken up by the bearings of the envelope and the links are not joined to the control ring so as to transmit forces, because their ends are in the form of pistons which slide in holes in the ring.

The envelope is advantageously formed by flanges or rings axially juxtaposed by assembly means allowing relative axial displacements of said flanges or rings, each of the latter being preferably associated with a single stage of pivoting blades. It is even better for the said flanges to be constituted by angular sectors separated by clearances sealed by the joints. All these envelope division arrangements and whereof the elements are particularly retained by a few fixing points to the casing, permit a significant reduction there of stresses and particularly those resulting from thermal expansions. It then becomes easy to design the envelope from a composite material having a relatively low resistance to the forces or stresses.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
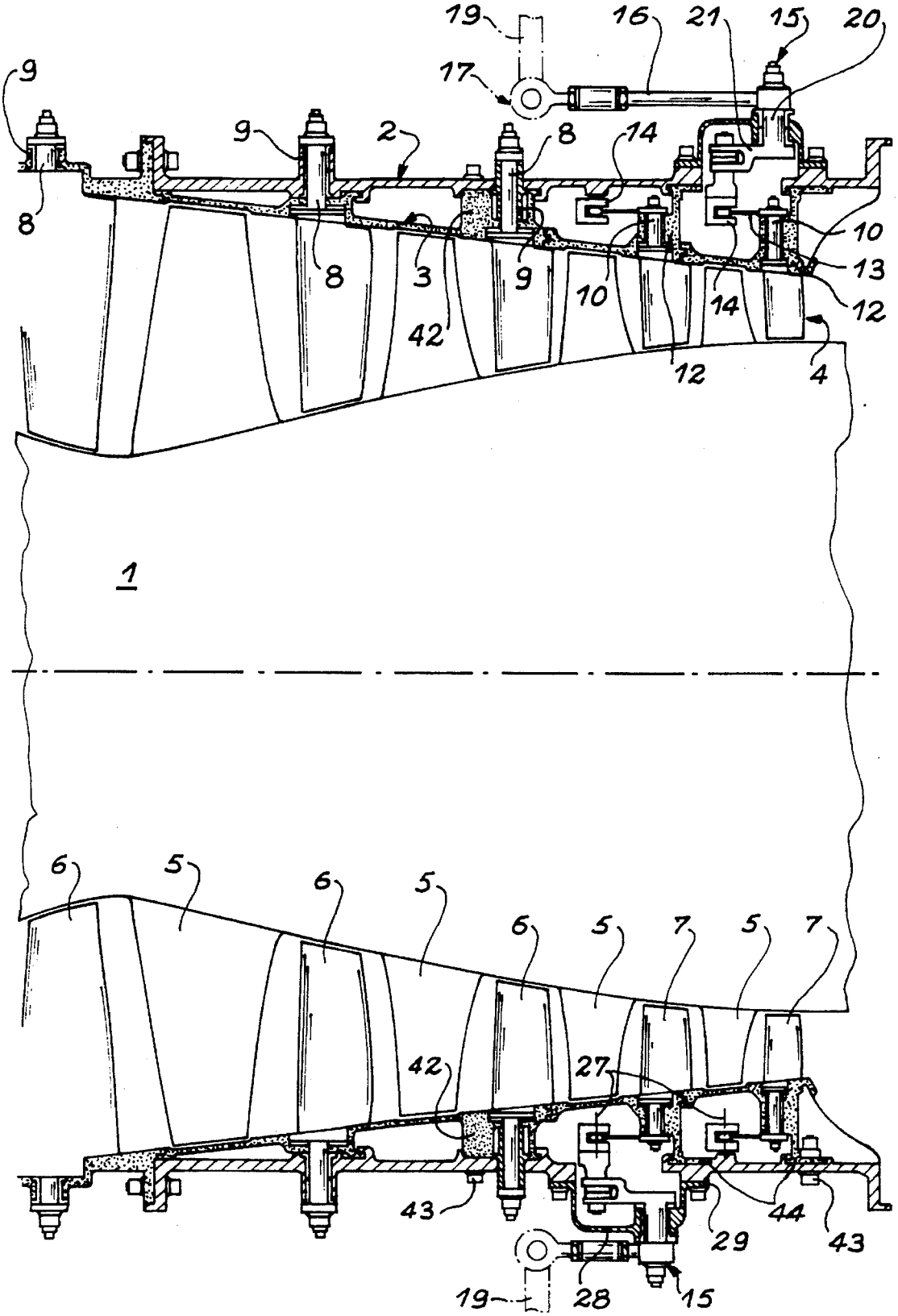
FIG. 1 illustrates a general representation of a first embodiment of the invention.

FIG. 1 shows a portion of a turbine engine and more specifically a compressor essentially constituted by a rotor portion 1 widening towards the downstream side, a cylindrical, titanium casing 2 and a composite material envelope 3 supported by the casing 2, which surrounds it and forms with it the framework of a stator, whose other components will be described hereinafter. The rotor 1 and envelope 3 define a passage or stream 4 occupied by several mobile blade stages 5 fixed to the rotor 1 and by several stator blade stages alternating with the first-mentioned stages and whereof the former (towards the upstream side) are constituted by fixed blades 6 and the two latter (towards the downstream side) are constituted by pivoting blades 7. Whereas the casing 2 is cylindrical in order to facilitate its manufacture, the envelope 3 is conical and its diameter is reduced towards the downstream side, where it is removed ever further from the casing 2. Thus, the fixed blades 6 are held by fixed spindles 8 engaged in support bushes 9 rigidly connected to the casing 2 or in one piece therewith, but the pivoting blades 7 have rotary spindles or pivots 10, which rotate in sleeves of bearings 11 (see FIG. 2) positioned across thickened regions 12 of the envelope 3. The pivots 10 project out of these thickened regions 12 and are joined at this point to respective links 13 by a screw, snap-in or similar known system ensuring a rigid connection in rotation, while the links 13 of each pivoting blade stage 7 are articulated by their opposite end to a common control ring 14 and more specifically to spindles 27 of said ring, which can be clearly seen in FIG. 2 and which therefore allow a full transmission of linear forces. The control rings 14 extend over an integral circumference in FIG. 1 between the casing 2 and the envelope 3 and are each moved by a control mechanism 15 constituted by a substantially lever 16 extending longitudinally (cf. also FIG. 3) and whereof one end 17 is mounted in pivoting manner on an arm 19 outside the casing 2 and whereof the opposite end 18 is fixed to a radial spindle 20, whereof it controls the pivoting. The spindle 20 is terminated by a lever 21, whose displacement causes that of the control ring 14, to which it is joined in the manner described hereinafter. The arm 19 rotates with an output shaft of a motor 29 about an axial rotation axis. The motor 29 is connected to a support structure 22.

The support structure 22 is constituted by at least one fixing segment 23 bolted to a flange 24 of the casing 2 or several of such segments joined by an axial spacer. In this construction, there are two support structures 22 in a diametrically opposing manner on the turbine engine and whereof each is associated with one of the control mechanisms 15 and one of the control rings 14. The situation differs slightly in FIG. 2, where it is in particularly possible to see the single radial spindle 20, together with the lever 16 and the support 22 and where the lever 21 is replaced by a double lever 121 connected to the two control rings 114 by its two opposite ends, unlike in the previous embodiment the spindle 20 is connected to the center of the double lever 121. There is no or virtually no structural difference between the control rings 114 and 14, but the arrangement thereof differs slightly because they are moved together so as to be controllable by the double lever 121 and are positioned between the two pivoting blade stages 7. The links 113 of the two stages, instead of being oriented substantially parallel as in the previous embodiment, are consequently oriented in opposite directions. The control mechanism is then designated 115 and the remainder of the description given hereinbefore still applies. Another solution consists of providing two diametrically opposite control mechanisms 115, like the mechanisms 15 in FIG. 1, whereof each will control half of the control rings 114, which would have the advantage of subdividing the force produced on the shaft 20 and making it symmetrical on the casing 2. The control of the half-rings or more generally the ring sectors does not differ from that of complete rings. It is merely necessary to synchronize the control mechanisms. This solution is not entirely shown, but FIG. 3 illustrates the ends, designated by reference number 214, and the control mechanisms 115 would be polarized in the center of the half-rings.

In all cases, the control mechanism 15 or 115 between the spindle 20 and the control rings 14 or 114 is generally too cumbersome to be housed in the space between the cylindrical casing 2 and the envelope 3 and this is why the casing 2 is hollowed out at this location and provided with a detachable boss projecting towards the outside and shaped like a bell 28, which is fixed by a flat outer ledge 29 to a flange 30 of the casing 2 by bolts 31 and whereof the center is provided with an opening carrying a sleeve constituting a bearing 32 for the spindle 20. The control lever 21 or 121 extends beneath the bell 28.

It is pointed out that ring-shaped sealing segments 60 are arranged around the bases 61 of the pivoting blades 7 and located in spotfacings 62 of the envelope 3. The sealing segments 60 are made from a composite material such as Avimide and have a thickness of about 1 mm. Their function is to prevent the impurities contained in the gases of the stream 4 from sliding up to the sleeves 11, which are made from a relatively soft material with a low friction coefficient, so as to protect the same from damage. Therefore the performance characteristics of the engine are protected. A similar arrangement is possible with other methods of fitting of the pivoting blades 7 to the envelope 3.

Figure 2:
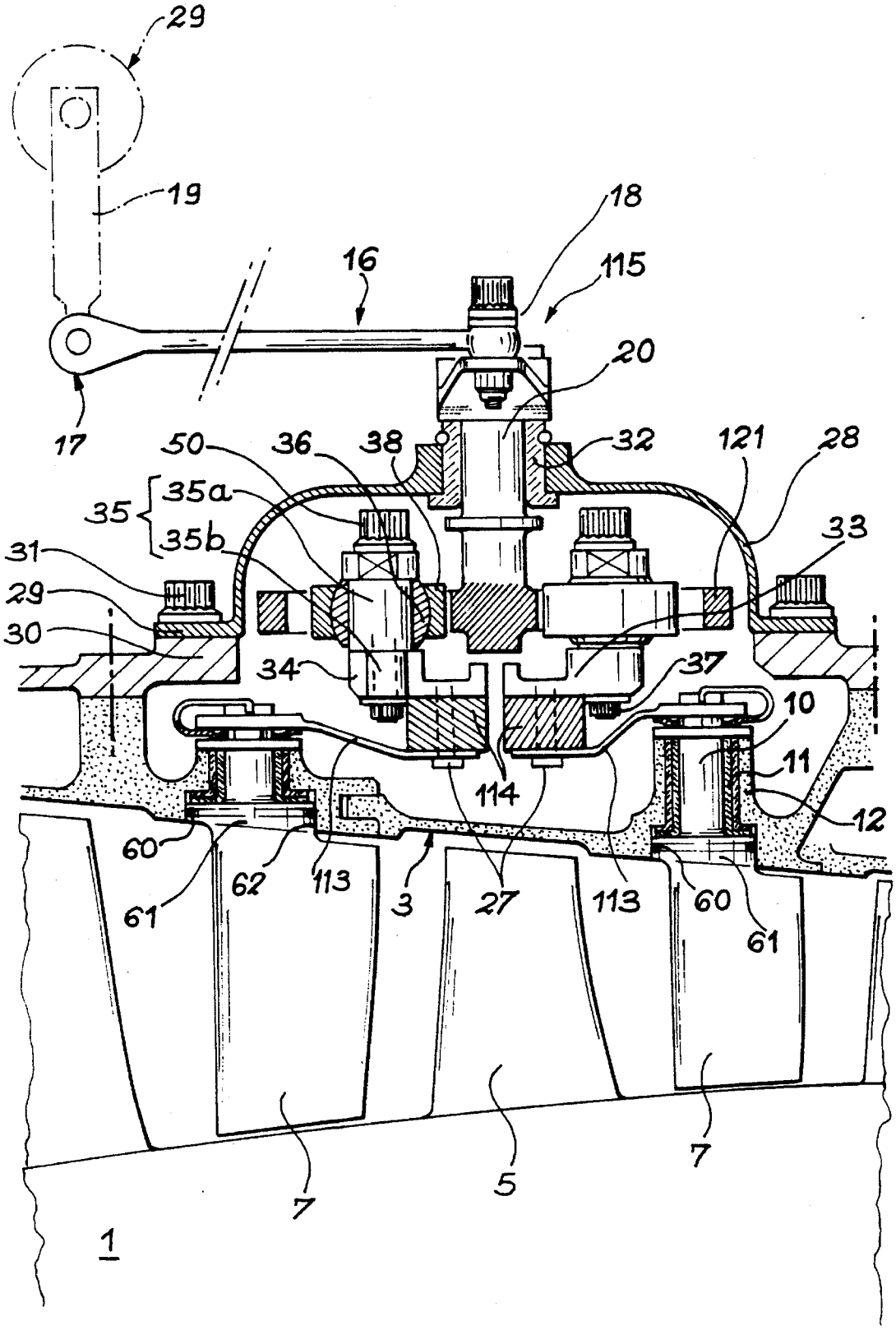
FIG. 2 shows a view of a second embodiment of the invention.
Figure 3:
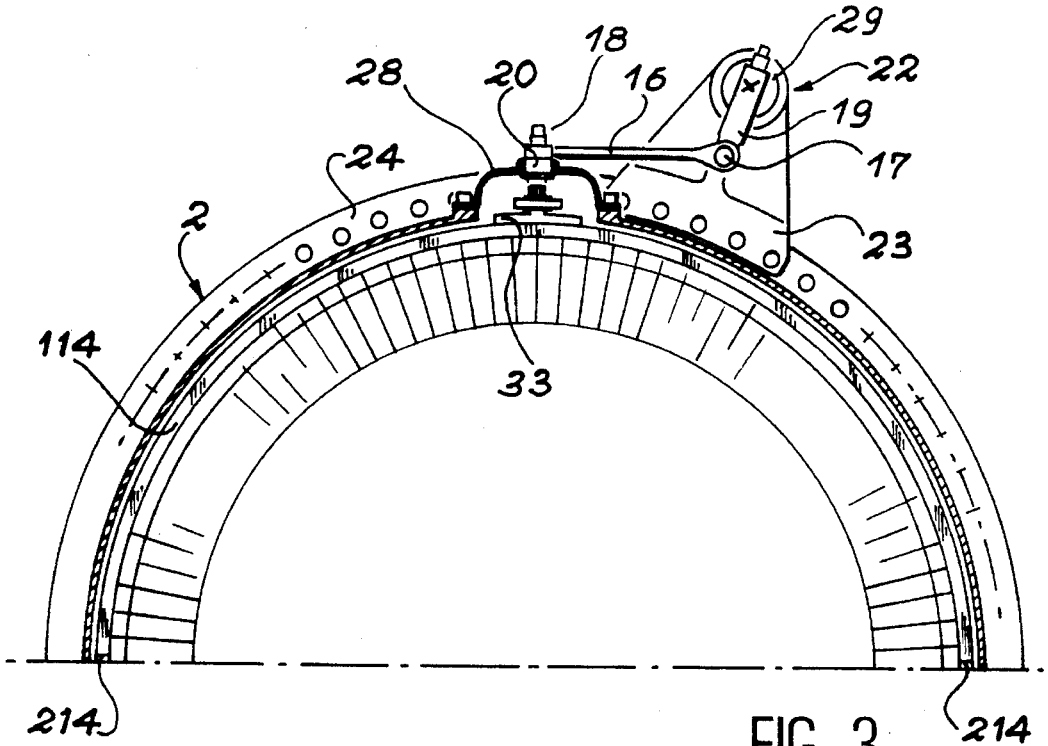
FIG. 3 shows a cross-sectional view of the embodiment of FIGS. 1 or 2.
Figure 4:
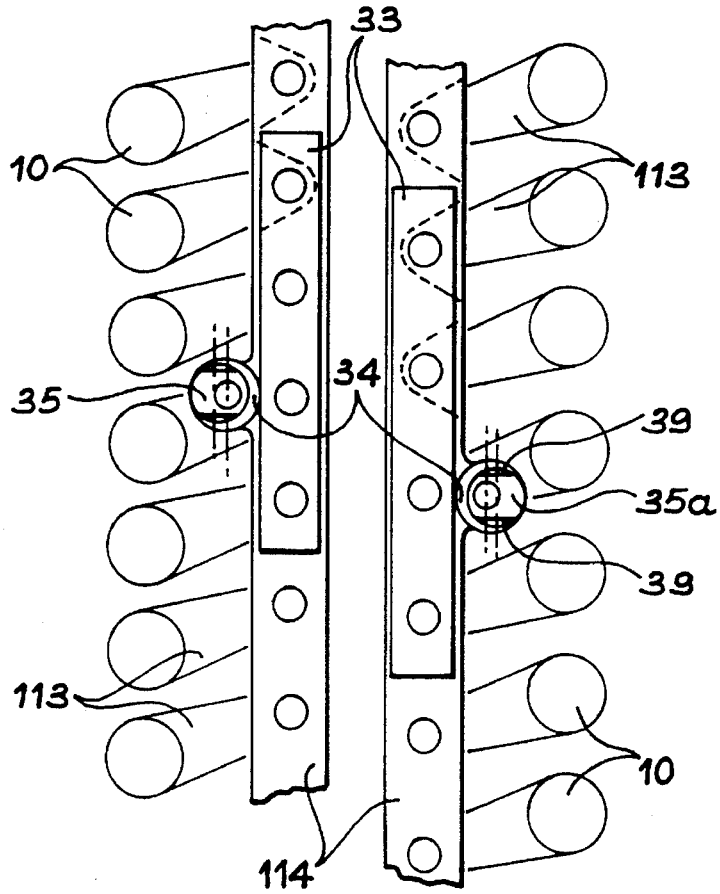
FIG. 4 shows the control ring, its attachment means to the remainder of the control mechanism and the links connecting it to the blade pivots.
Figure 5B:
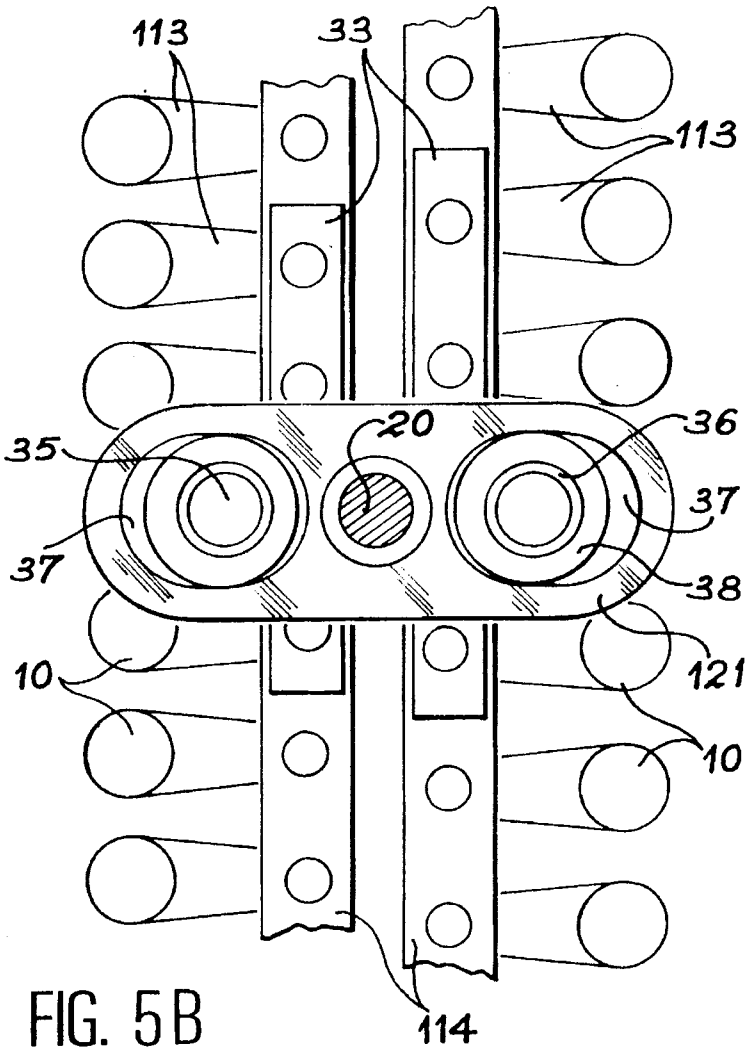
FIGS. 5A and 5B shows the control mechanism between the stress support spindle and the control ring.
Figure 5A:
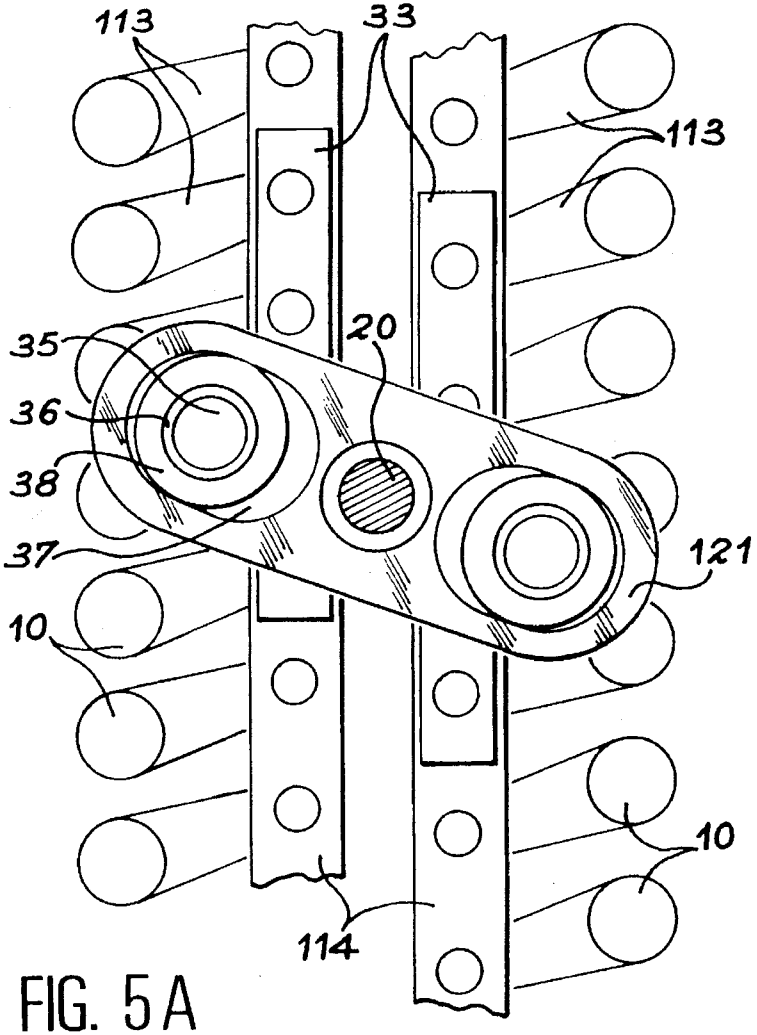

Reference will now also be made to FIG. 4 and FIGS. 5A and 5B for continuing the description of the embodiment of FIG. 2, but this description could also be transposed to the embodiment of FIG. 1.

The control rings 114 are provided with a spar 33, from which projects a bracket 34 and which carries a rod 35 oriented in the radial direction, i.e. parallel to the spindle 20. An externally spherical socket 36 shown in FIGS. 2 and 5 is engaged around the rod 35. It constitutes a swivel joint with a flange 38, which can rock on it and therefore has an internal spherical edge and an external cylindrical edge. The rod 35 is formed from a visible portion **35*a* passing out of the bracket 34 and which receives the socket 36 and a root portion 35*b* engaged in a cutout of the bracket 34. The two portions of the rod 35 are cylindrical, but their axes do not coincide. The rod 35 forms a cam by means of which it is possible to bring about some movement of the bracket 34, the spar 33 and the control ring 14 in order to finely regulate the setting of the pivoting blades 7 without moving the double lever 121. This operation is carried out during periodical maintenance settings of the machine. For this purpose the visible portion 35*a* is provided with opposite flats 39 (FIG. 4), which can be grasped by a wrench in order to rotate the rod 35. When the setting has been completed, a bolt 50 entirely traversing the rod 35 is fitted in order to lock it in rotation against the bracket 35 while holding the socket 36** by a washer or a screw head.

The double lever 121 is provided with two elongated openings 37 in-each of which slides one of the flanges 38. FIGS. 5A and 5B show two states corresponding to the two extreme travels of the double lever 121 for which the flanges 38 arrive at the respective ends of the elongated openings 37. These positions correspond to the extreme settings permitted for the pivoting blades 7, whose angular displacement is similar to that of the links 13.

Such a system having cams and elongated openings also exists on the single levers 21 of the other embodiment.

Figure 6:
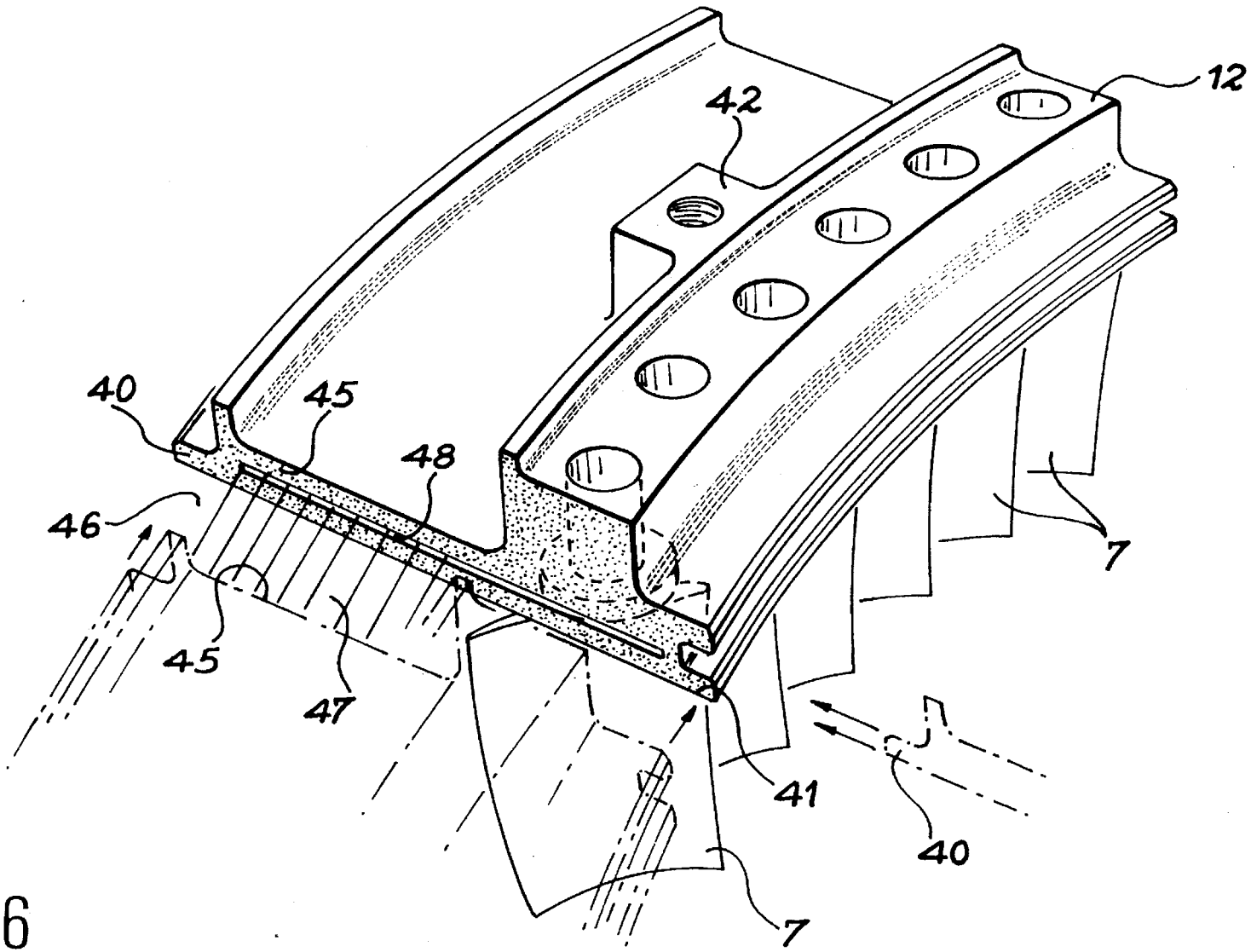
FIG. 6 shows the envelope and the blades.

FIG. 6 shows that the envelope 3 is constituted by ferrules and terminated by mortise 41 and tenon 40 systems making it possible to join the flanges to one another by juxtaposing them in the axial direction. Each flange is associated with a stator blade stage and therefore comprises a thickened region 12 into which pass the spindles 8 or pivots 10. It can be seen that these thickened regions 12 sometimes widen in order to form tapped bosses 42 in which are engaged the bolts 43 clearly visible in FIG. 1 and which join the flanges to the casing 2. The bosses 42 can also be replaced by equivalent structures such as fixing ledge ribs 44 for certain of the blade stages.

The flanges of the envelope 3 are advantageously subdivided into sectors, each extending over a circumferential portion and which are therefore terminated by transverse edges 45 separated by clearances 46. This arrangement, which is beneficial for relieving the envelope 3 from thermal expansion differential stresses, makes it necessary to reestablish the seal at these points by means of leaf joint members 47, which are conventionally used in this technical field and which cover the clearances 46 by projecting over consecutive sectors of the flanges and by penetrating the slits 48 issuing onto the transverse edges 45. Other packings, which can consist of undulating leaf springs which the tenons 40 compress at the bottom of the mortises 41 make it possible to complete the seal. These other packings are optional and are not illustrated, particularly as they are known.

The invention makes it possible to eliminate all leaks due to the widening of dozens or hundreds of bearings 11. Wear is concentrated on the bearings 32, whereof there are only a few on the turbine engine and which do not issue into the stream or passage 4, so that their wear is not responsible for leaks. If, however, the replacement of a bearing 34 has been agreed, this is rapidly carried out due to the small number thereof and their presence on the casing 2, at an external location of the turbine engine more readily accessible than the envelope 3.

The residual stresses on the bearings 11 of the pivots 10 are compensated by small ring sector displacements able to act axially and angularly as a result of the mortise 41 and tenon 40 systems and the clearances 46, without any leaks or stresses occurring. Therefore there is no loading of the bearings 11. Obviously, the direction of the levers 21 and 121 has been chosen so that the thrust received by the pivoting blade 7 is effectively transmitted by the flanges 36 to said levers, i.e. is substantially perpendicular to the axis of the elongated openings 37.

The parts of the control mechanisms 15 or 115 located outside the bells 28 can have shapes differing very greatly from that illustrated and which are in reality independent of the actual invention.

Obviously, numerous modifications and variations of the present invention are possible in light of the above teachings. It is therefore to be understood that within the scope of the appended claims, the invention may be practiced otherwise than as specifically described herein.

We claim:

1. Turbine engine stator, which comprises:

an envelope having a plurality of bearings;

a plurality of blades respectively pivotable about pivots engaged with said bearings of said envelope wherein said envelope includes flanges axially juxtaposed by assemblies allowing relative axial displacement of the flanges and the envelope defines a gas stream in which the blades extend;

a casing surrounding the envelope and having a casing bearing wherein the pivots are joined by links to at least a sector of at least one control ring positioned outside the envelope; and at least one control mechanism controlling the control ring wherein the control ring includes a spindle which engages the casing bearing wherein the flanges comprise angular sectors which are respectively separated by clearances, wherein joint members respectively seal said clearances and wherein the envelope comprises a composite material and the casing comprises titanium.

2. Turbine engine stator, which comprises:

an envelope having a plurality of bearings a plurality of blades respectively pivotable about pivots engaged with said bearings of said envelope wherein said envelope includes flanges axially juxtaposed by assemblies allowing relative axial displacement of the flanges and the envelope defines a gas stream within which the blades extend;

a casing surrounding the envelope and having a casing bearing wherein the pivots are joined by links to at least a sector of at least one control ring positioned outside the envelope;

at least one control mechanism controlling the control ring wherein the control ring includes a spindle which engages the casing bearing wherein the flanges comprise angular sectors which are respectively separated by clearances and joint members are provided which respectively seal said clearances;

the control mechanism comprises a lever connected to the spindle, the lever having an elongated opening wherein a member connected to the control ring is slidable in the elongated opening.

3. Turbine engine stator of claim 1, which comprises:

an envelope having a plurality of bearings;

a plurality of blades respectively pivotable about pivots engaged with said bearings of said envelope wherein the envelope includes flanges axially juxtaposed by assemblies allowing relative axial displacement of the flanges and the envelope defines a gas stream in which the blades extend;

a casing surrounding the envelope and having a casing bearing wherein the pivots are joined by links to at least a sector of at least one control ring positioned outside the envelope;

at least one control mechanism controlling the control ring wherein the control ring includes a spindle which engages the casing bearing wherein the flanges comprise angular sectors which are respectively separated by clearances and joint members are provided which respectively seal said clearances, and wherein the at least one control ring comprises a first and second control ring; and the blades are subdivided into two stages, each stage being controlled by one of said first and second control rings, and wherein the at least one control mechanism comprises two control mechanisms comprises which are associated with a respective control ring and located on diametrically opposite sides of the stator.

4. Stator according to claim 3, wherein the member includes a cam regulating the control ring with respect to the lever.

5. Stator according to claim 1, wherein the pivoting blades are subdivided into two stages, each stage being controlled by the control ring, and wherein the control mechanism controls each control ring with the spindle.

6. Stator according to claim 1, wherein the pivoting blades are subdivided into two stages, each of said two stages being controlled by a pair of control half-rings and wherein the at least one control mechanism comprises two control mechanisms located, respectively on diametrically opposite sides of the stator, and each of said control mechanisms engaging with a different pair of half-rings.

* * * * *